US005168987A

United States Patent [19]

Warwicker

[11] Patent Number: 5,168,987

[45] Date of Patent: Dec. 8, 1992

[54] CASHBOX

[75] Inventor: Clive W. Warwicker, Cookley Near Kidderminster, England

[73] Assignee: Helix Group PLC, Stourbridge, Great Britain

[21] Appl. No.: 847,863

[22] Filed: Mar. 9, 1992

Related U.S. Application Data

[63] Continuation of Ser. No. 359,503, Jun. 1, 1989.

[30] Foreign Application Priority Data

Jun. 8, 1988 [GB] United Kingdom ..... 8813580

[51] Int. Cl.[5] ..... A45C 1/00

[52] U.S. Cl. ..... 206/0.81; 206/0.83; 232/4 R; 232/10

[58] Field of Search ..... 206/0.8, 0.81, 0.82, 206/0.83, 0.84, 561, 564, 373, 315.11; 220/507, 23.4; 312/293; 232/4 R, 7, 10; 446/8

[56] References Cited

U.S. PATENT DOCUMENTS

| | | | |
|---|---|---|---|
| 374,149 | 11/1887 | Foster | 206/0.83 |
| 455,624 | 7/1891 | Jones | 206/0.81 |
| 886,345 | 5/1908 | Burns | 206/0.81 |
| 1,146,230 | 7/1915 | Anderson | 232/4 R |
| 1,463,360 | 7/1923 | Foote | 220/23.83 |
| 2,213,821 | 9/1940 | McCurdy | 190/111 |
| 2,508,283 | 5/1950 | Nelson et al. | 206/0.81 |
| 2,522,768 | 9/1950 | Wiepert | 206/0.81 |
| 2,804,197 | 8/1957 | Popkess et al. | 206/0.81 |
| 3,410,018 | 11/1968 | Woolworth | 206/315.11 |
| 4,611,711 | 9/1986 | Warwicker | 206/0.81 |
| 4,756,406 | 7/1988 | Grounds | 206/0.81 |

FOREIGN PATENT DOCUMENTS

| | | |
|---|---|---|
| 2490191 | 3/1982 | France . |
| 2510366 | 2/1988 | France . |
| 2155443 | 9/1985 | United Kingdom . |

*Primary Examiner*—Paul T. Sewell
*Assistant Examiner*—Jacob K. Ackun, Jr.
*Attorney, Agent, or Firm*—Bauer & Schaffer

[57] ABSTRACT

A cash box has a loose coin tray which rests on a peripheral seal seated on a plain free edge defining a lip of a base of the cash box. The coin tray is supported by the seal and has a peripheral flange which rests on six inwardly directed tabs of the seal. The tray and the seal may be manufactured together as a one-piece plastics moulding and the moulding cut to separate the tray from the seal.

13 Claims, 3 Drawing Sheets

CASHBOX

This is a continuation of Ser. No. 359,503, filed: Jun. 1, 1989.

This invention relates to a cashbox of a type having a peripheral seal interposed between a lid and base of the box.

As explained in our previous patent application No. 2155443A (the content of which is hereby incorporated by reference), such a construction permits both the lip of the lid (top part) and lip of the base (bottom part) to be provided by a plain free edge which facilitates manufacture. Nevertheless, in cashboxes made in accordance with the general design shown in 2155443A the peripheral seal (outwardly extending rim of coin tray) is integral with a coin tray and in order to gain access to the interior of the base the coin tray has to be removed and this action also necessarily involves removal of the peripheral seal from the base. The design shown in the drawings of 2155443A has a lid and a base of similar size and a coin tray with wall portions which extend upwards beyond the mouth of the base and into the lid when the box is closed. In order to remove the coin tray to gain access to the interior of the base, said wall portions can be gripped relatively easily by the fingers of a person's hand or hands and the tray removed with the seal without too much inconvenience. However, when the tray is relocated in the base the seal has to be seated correctly once again on the base, and although such an action may not require a very substantial amount of dexterity (at least for an able person) it is still possible that some measure of difficulty may be encountered in seating the seal correctly and, in any event, if the seal did not have to be removed on every occasion with the tray it could be arranged to seat much more tightly on the base. If the seal is not located entirely correctly on the base it is possible that it may be broken, perhaps on closing the lid and, particularly in other arrangements, if the design of the coin tray is modified to omit the upstanding wall portions, there may be no convenient means to grip onto in order to remove from, and relocate, the coin tray and seal relative to the base.

Additionally, such cashboxes are restricted to use with the coin tray since they cannot be closed and locked properly while the seal (with its integral coin tray) is removed. In some instances it may tend to be disadvantageous not to be able to close and lock the box properly without the coin tray, since, for example, a reduced storage volume is available in the box while the coin tray is provided therein.

It is an object of the present invention to at least alleviate at least one of the aforementioned disadvantages.

According to the present invention there is provided a cash box comprising a base and a lid releasably lockable thereto by a locking mechanism, said box having a coin tray and a peripheral seal interposed between the base and lid, said seal being arranged, in use, to remain seated on one of the lid and base of the box when the coin tray, or a part thereof, is moved relative thereto, in order to permit access to the interior of the base.

Usually, the coin tray (or at least a part thereof) will be removable from the box, leaving the seal intact on the box. Thus, advantageously, the cashbox is not restricted to use with the coin tray (or at least a part thereof) and said box can be closed and locked properly even when the coin tray (or at least a part thereof) has been removed, thereby providing a larger storage volume than would otherwise be the case. Usually, the seal will be arranged to support the coin tray (or at least a part thereof) so that the coin tray rests (preferably loosely) on the seal and the seal is seated on the base. Nevertheless, variations in design are possible, for example the coin tray could be hinged to the seal to allow access for the interior of the box without removing the tray (the hinge may be integrally formed). Alternatively, or additionally, part of the tray could be hinged to the seal or another part of itself in order to allow access to the interior of the base. It is possible that the seal may remain seated on the lid (rather than on the base) with the tray being seated on the base such that in the closed position of the box the tray is held in between the seal and said base.

In one embodiment of the present invention, the seal is seated on the base (usually on a plain free edge thereof defining a lip) and the coin tray rests loosely on inwardly directed portions (usually tabs) of the seal. Preferably, the coin tray and seal are moulded integrally and then cut from one another in such a manner that upon appropriate relative re-orientation (e.g. relative rotation through 180°) the tray will rest on the seal. The tray may have a flange which rests on six inwardly directed tabs of the seal.

The locking mechanism may comprise a cylinder lock (usually key operated) having a locking tongue co-operable with a locking bar (or other retention means) on the lid. The tongue may have a notch which receives the bar in a locking position.

Further advantageous features of the present invention will be apparent from the following description and drawings.

An embodiment of a cashbox in accordance with the present invention will now be described, by way of example only, with reference to the accompanying drawings in which.

Figure 1:
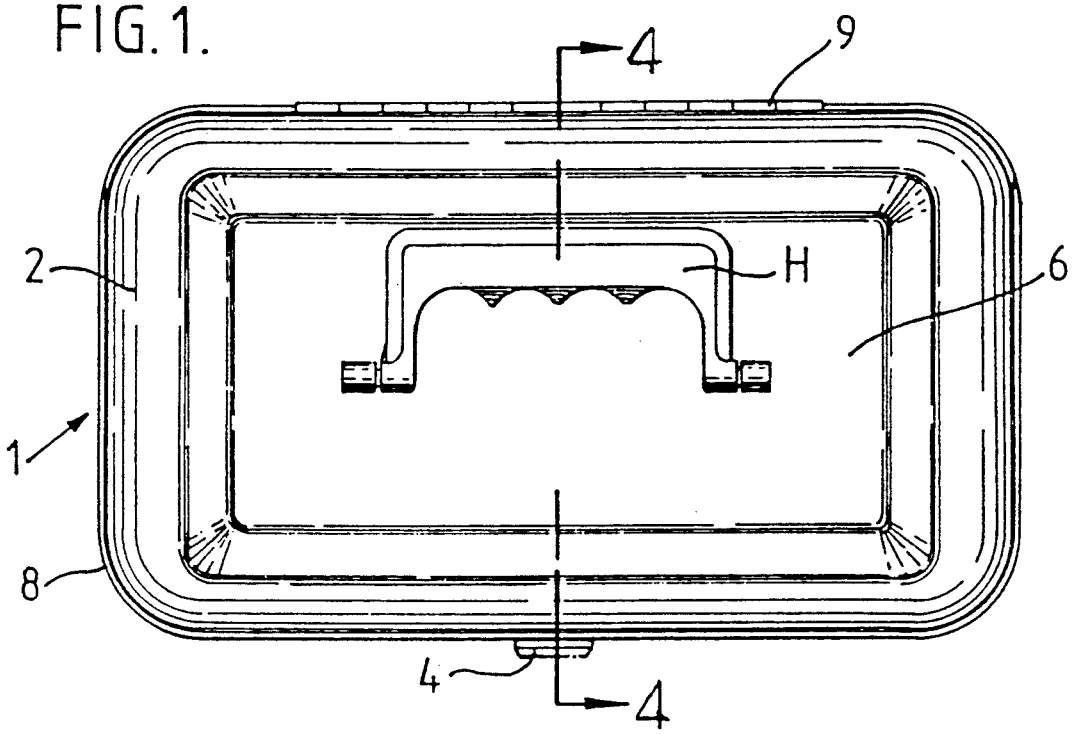
FIG. 1 shows a plan view of the cashbox in a closed position.

FIGS. 1 to 6 show a cashbox 1 of the general type shown in our patent application No. 2155443A. The main features of difference between the cashbox shown in that patent application and the cashbox 1 reside in the fact that the cashbox 1 has a lid 2 of smaller depth than base 3; a key-operated cylinder lock 4 is provided on a front wall portion 5 of the box 3 (rather than on a top panel portion 6 of the lid 2) and in that a different form of coin tray 7 and peripheral seal or seating or location bead 8 are provided. Therefore, the present description will be generally directed to discussion of these features.

Figure 3:
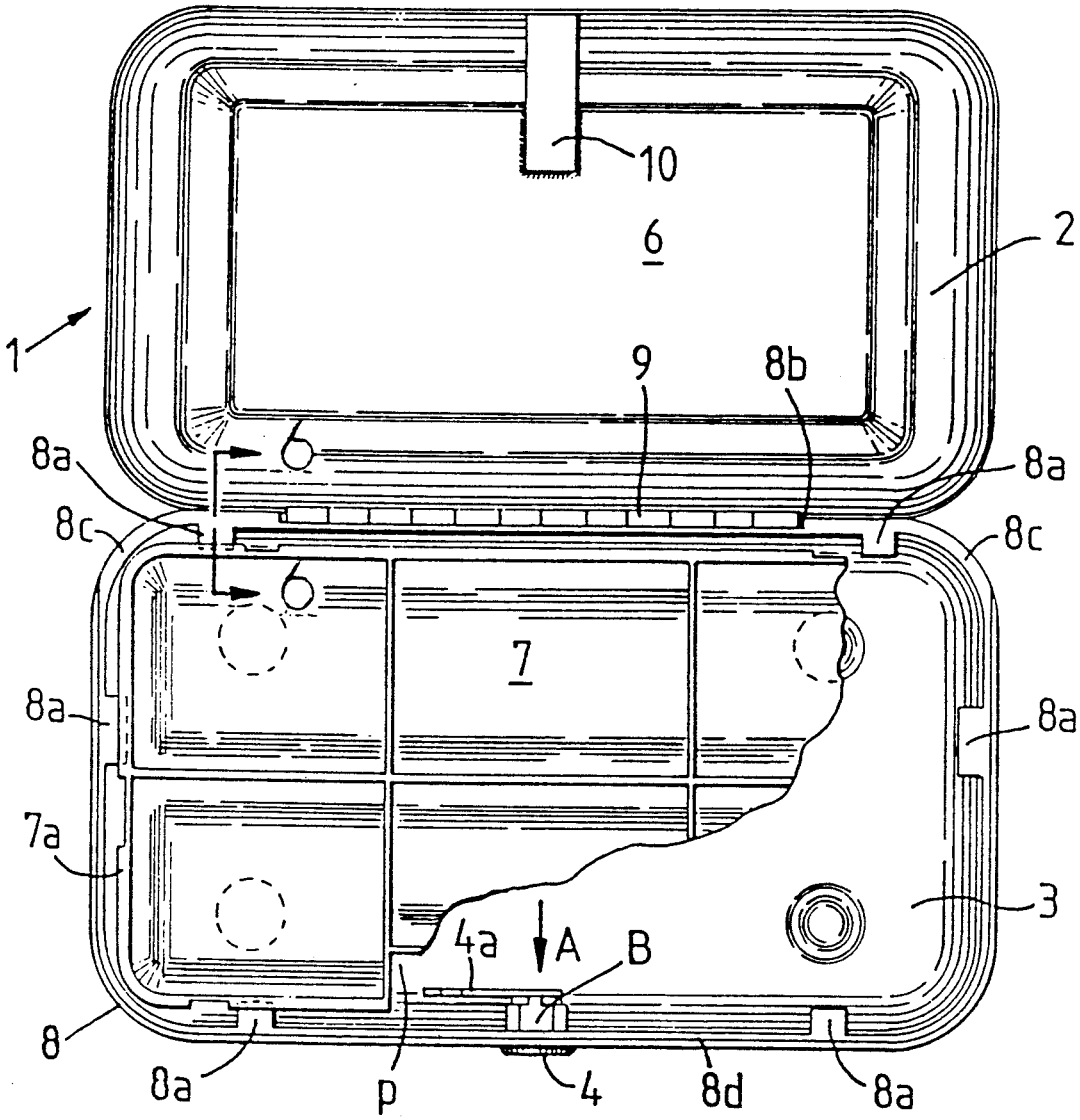
FIG. 3 shows a plan view of the box in an open position.
Figure 6:
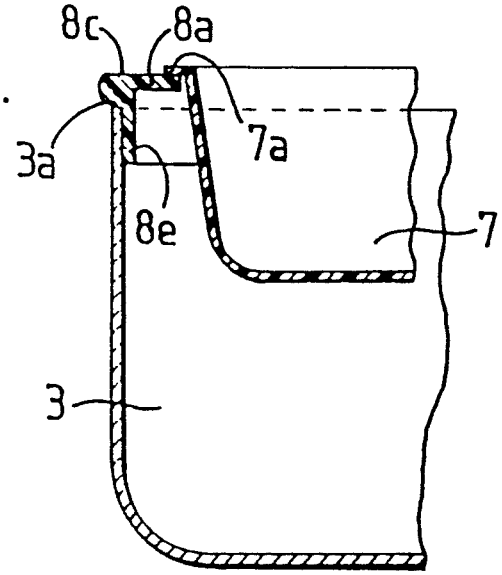
FIG. 6 shows a fragmentary sectional view taken on line VI–VI of FIG. 3.
Figure 4:
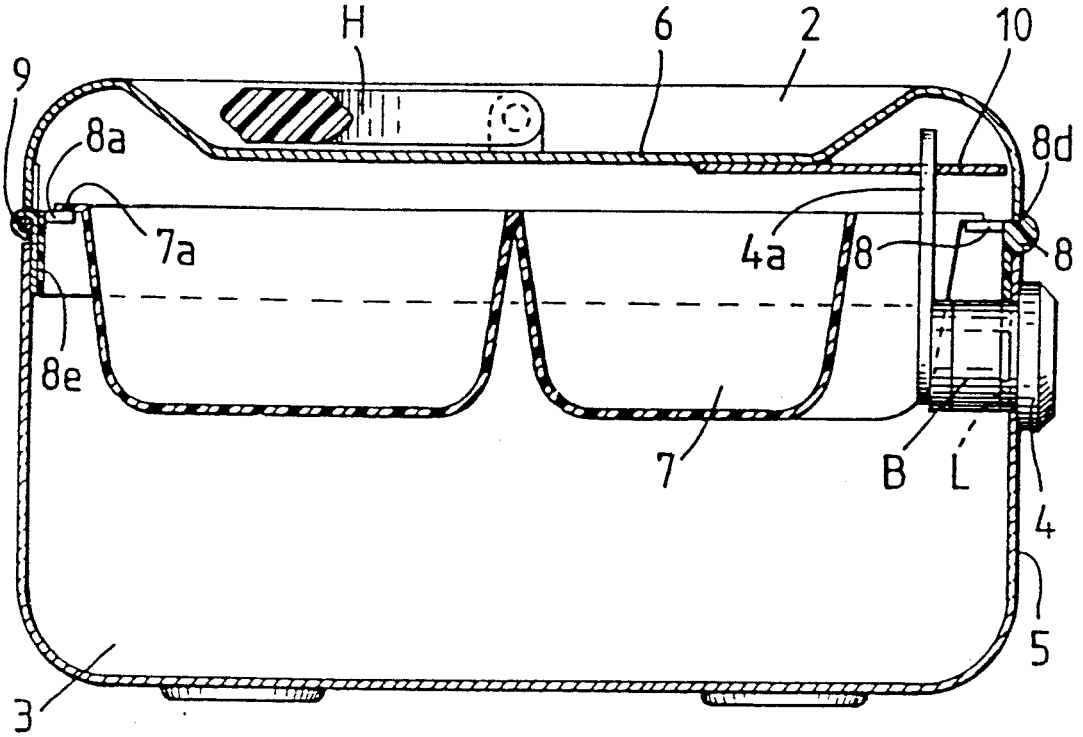
FIG. 4 shows a sectional view of the box taken on line IV–IV of FIG. 1.
Figure 7:
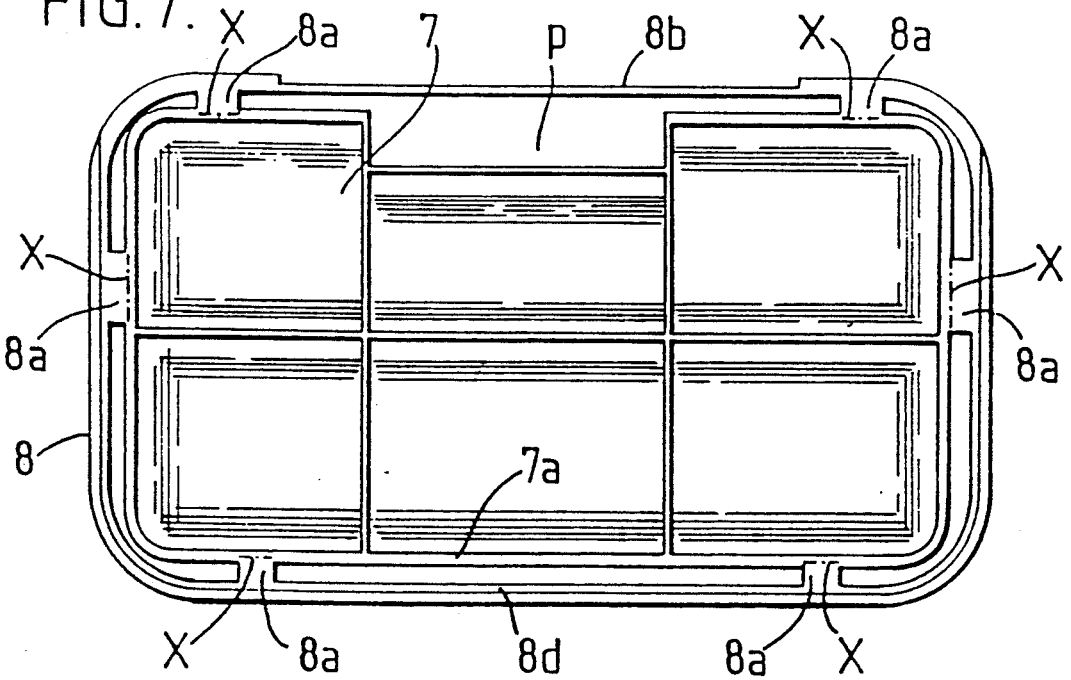
FIG. 7 shows a plan view of a coin tray and peripheral seal of the box just after removal from a mould (not shown).

FIG. 3 shows the cashbox 1 in an open position with the peripheral seal 8 seated on a plain free edge defining a lip 3*a* of the base 3. The coin tray 7 is supported by the seal 8 and has a peripheral flange 7*a* which rests loosely on, but is removable from, six inwardly directed, tabs 8*a* of the seal 8. Part of the coin tray 7 has been shown cut-away in FIG. 3 for ease of illustration. The reason for the slightly irregular configuration of cooperating flange 7*a* and tabs 8*a* as shown in FIG. 3 should be apparent from FIG. 7 which shows that, in this instance, the tray 7 and seal 8 are produced originally together as a one-piece plastics moulding (again for ease of manufacture). The moulding 7, 8 is then cut along the various chain-dotted lines X (see FIG. 7) in a manner which should be evident when viewed in conjunction with FIG. 3, in order to form the tabs 8*a* which will support the flange 7*a*, on rotation through 180° of the tray 7 relative to the seal 8 in the plane of the paper as shown in FIGS. 3 and 7. The overall configuration of the coin tray 7 should be apparent from the FIGURES, and in this instance, it will be noted that wall portions of the tray 7 do not extend up into the lid 2 when the cashbox 1 is closed.

Figure 2:
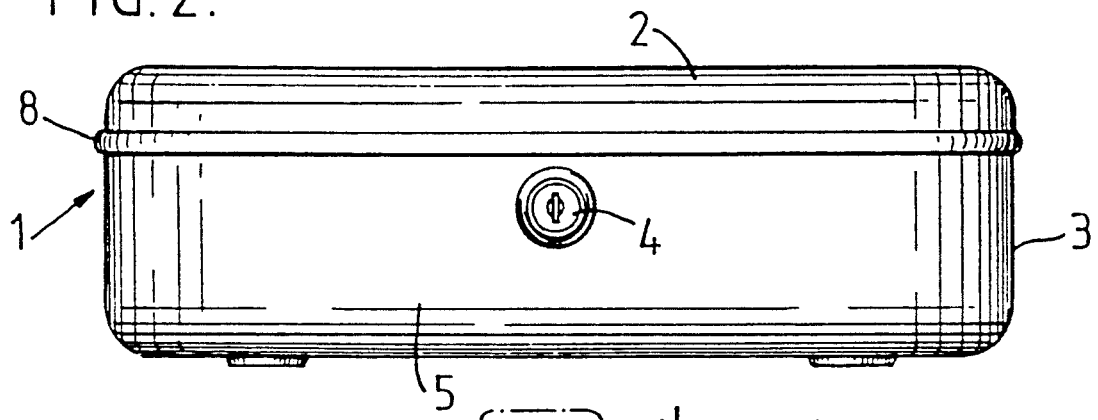
FIG. 2 shows a front elevational view of the box.
Figure 5:
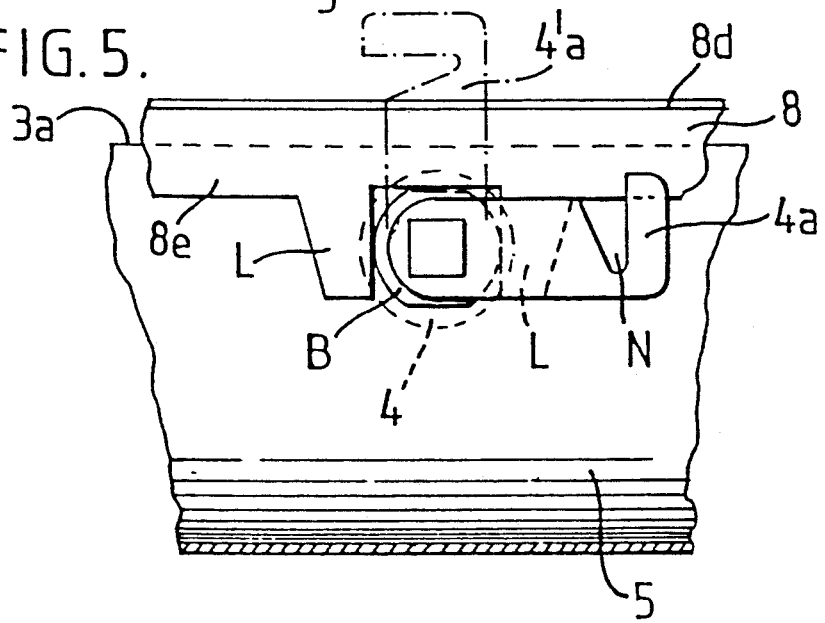
FIG. 5 shows a fragmentary view looking in the direction of arrow A in FIG. 3.

The seal 8 itself is a very tight fit on the lip 3*a* of base 3 since it is designed essentially to remain attached to the base at all times, although it is still removable if required. The seal 8 has a rectangular cut-out portion 8*b* (see FIG. 7) which very closely embraces hinge 9. The upper surface 8*c* of seal 8 is flattened at the back thereof to accommodate the back edge of the lid (see FIG. 3 and FIG. 6) but is provided with a slightly raised rim 8*d* (see FIG. 3 and FIG. 4) which extends around the front and sides of the seal and which marginally overlaps front and side wall portions of the lid 2 when the box 1 is closed. The seal 8 has a main wall 8*e* which extends downwardly and engages tightly against the inside of the base (see FIG. 6). Additionally, to aid in tight engagement and correct location of the seal 8 on box 3, two taped lugs L forming downwardly depending extensions of the main wall 8*e* closely embrace the barrel B of the cylinder lock 4 (see FIG. 5). FIG. 2 shows how the seal 8 appears interposed between the lid 2 and base 3 when the box 1 is closed.

From the foregoing description and drawings the form of the coin tray 7 and seal 8 should be readily apparent as will be the seating of the seal on the base, the loose support of the tray on the seal and easy removal of the tray from the seal, when required, merely by lifting the tray off the seal, in order to gain access to the interior of the base. Additionally, the cash box by way of its peripheral seal 8 is lockable in a tamper-proof manner and functional with the coin tray removed.

The lid 2 is releasably lockable to the base 3 by locking mechanism 4, 10 comprising the cylinder lock 4 and locking bar 10 welded in position on the underside of the lid (see FIG. 3). Lock 4 has a notched tongue 4*a* which is rotatable with the barrel B of the lock from a nonlocking position (FIG. 5) to a locking position 4'a (shown in chain dotted lines in FIG. 5—also see FIG. 4) in which the bar 10 is received in notch N of the tongue 4*a*. The centre front portion p of tray 7 is recessed so as to provide clear freedom of movement for the tongue 4*a*. A handle H is provided in a recessed part of the top wall portion 6 of the lid 2.

The present invention could be utilised with a lid and base of similar depth and the coin tray itself may be configured to extend into the lid when the box is closed. The tray and seal need not necessarily be originally made integrally but such a production method has obvious cost advantages. In other embodiments the lock could be provided on the lid.

It is to be understood that the scope of the present invention is not to be unduly limited by the particular choice of terminology and that a specific term may be replaced by any equivalent or generic term where sensible. Further it is to be understood that individual features, method or functions related to the cash box, coin tray or seal and/or combinations thereof might be patentably inventive.

Therefore, for example, there is further provided in accordance with the present invention a method of making a coin tray and peripheral seal for a cashbox having a lid and a base, said method comprising:

a) moulding the coin tray and peripheral seal in one piece;

b) separating the coin tray from the seal and reorientating the tray relative to the seal in use on the cashbox such that the tray rests on the seal with said seal being seated on the base, said tray being readily removable from the box, in order to give access to the interior of the base, with the seal remaining seated on the base.

Further according to the present invention there is provided a cashbox having a peripheral seal which is non-integrally formed with the box and which is interposed or interposable between a lid and base of the box, said box having a coin tray (or at least a part thereof) which is removable from the box, said box being closable and lockable while said coin tray (or at least said part thereof) is removed.

What we claim is:

1. A cash box comprising a base, a hinged lid closable thereon, a coin tray received within said base and means for releasably securing said lid to said base to enclose said coin tray therein, and a peripheral sealing bead attached to the edge of one of said base and lid to be interposed between said base and lid when said lid is closed on said base and to remain fixed as attached when said lid is opened and said coin tray moved with respect to said base, wherein at least a part of said coin tray is removable from said cash box and wherein said coin tray is provided with a peripheral flange for resting upon said sealing bead for support when said sealing bead is attached to said base and wherein said sealing bead extends between the edges of said base and lid and is compressed therebetween when said lid is closed.

2. The cash box according to claim 1, wherein said sealing bead is provided with inwardly directed tabs extending beneath the peripheral flange when said sealing bead is attached to said base and said tray is resting on said sealing bead.

3. The cash box according to claim 1, including hinge means attaching said coin tray to said sealing bead, when said sealing bead is attached to said base, said coin tray being pivotal with respect to said base to allow access to the interior thereof.

4. The cash box according to claim 1, in which the hinge means is integrally formed with said coin tray and said sealing bead.

5. A cash box comprising a base and a lid releasably lockable thereto by a locking mechanism, said box having a coin tray having flange means for supporting said coin tray within said cash box and a peripheral sealing bead seated interposed between free edges of the base and lid, said sealing bead being arranged, in use, to remain seated on one of the free edges of the lid and base of the box when the box is opened and at least a part of the coin tray is moved relative to the base, in order to permit access to the interior of the base, and in which the sealing bead remains seated on the lid with the tray being seated on the base when the box is opened such that in the closed position of the box, said flange means of the tray is held in between the sealing bead and the free edges of said base.

6. The cash box as claimed in claim 5, in which at least a part of the coin tray is removable form the box, leaving the sealing bead intact on the box.

7. The cash box according to claim 4, in which the sealing bead is seated on a plain free edge of the base defining a lip.

8. The cash box as claimed in claim 4, in which said at least part of the coin tray is hinged to the sealing bead to allow access to the interior of the box without removing the tray.

9. The cash box as claimed in claim 8, in which the hinge is integrally formed with the coin tray and the sealing bead.

10. The cash box as claimed in claim 4, including a locking mechanism comprising a cylinder lock having a locking tongue cooperable with a locking bar on the lid.

11. The cash box as claimed in claim 10, in which the lock is key operated.

12. The cash box as claimed in claim 11, in which the tongue has a notch which receives the bar or other retention means in a locking position.

13. A cash box comprising a base and a lid releasably lockable thereto, said cash box having a shallow coin tray and a removable peripheral sealing bead seated on the free edge of the base between the base and the lid, said sealing bead remaining seated on the base on removal of the coin tray from the cash box, said cash box being closable and lockable with the coin tray removed, access to the interior of the base being permitted on removal of said coin tray from the cash box, said coin tray having a peripheral flange which overlaps the sealing bead, when the coin tray is supported within the base, said sealing bead having a portion which is generally L-shaped in cross-section engaging said free edge of the base to be firmly seated on that edge.

* * * * *